United States Patent [19]

Haselwander et al.

[11] Patent Number: 5,052,309

[45] Date of Patent: Oct. 1, 1991

[54] TRACK CARRIER FOR A HIGH SPEED MAGNETIC LEVITATION TRANSPORT SYSTEM

[75] Inventors: Bernhard Haselwander, Oberursel; Werner Jonas, Homburg; Henning Riech, Neu-Isenburg, all of Fed. Rep. of Germany

[73] Assignee: Hochtief Aktiengesellschaft vorm. Gebr. Helfmann, Essen, Fed. Rep. of Germany

[21] Appl. No.: 429,934

[22] Filed: Oct. 30, 1989

[30] Foreign Application Priority Data

Nov. 8, 1988 [DE] Fed. Rep. of Germany ..... 3837774

[51] Int. Cl.[5] ..... E01B 26/00

[52] U.S. Cl. ..... 104/124; 104/125

[58] Field of Search ..... 104/124, 125, 126; 248/218.4, 219.2; 52/73, 174, 602

[56] References Cited

U.S. PATENT DOCUMENTS

| | | | |
|---|---|---|---|
| 3,257,764 | 6/1966 | Cripe | 52/174 |
| 3,566,557 | 3/1971 | Comolli | 52/73 |
| 3,859,682 | 1/1975 | Sulkiewicz | 52/174 |
| 3,919,947 | 11/1975 | Simon et al. | 104/124 |
| 4,029,019 | 6/1977 | Watkins | 104/124 |
| 4,270,458 | 6/1981 | Schwartzkopf | 104/125 |
| 4,571,913 | 2/1986 | Schleich et al. | 52/334 |

FOREIGN PATENT DOCUMENTS

| | | | |
|---|---|---|---|
| 2744367 | 5/1979 | Fed. Rep. of Germany | 104/124 |

OTHER PUBLICATIONS

*Bauingenieur*, 63, 1988, pp. 463–469, R. Kindmann et al.

*Primary Examiner*—Robert J. Oberleitner
*Assistant Examiner*—S. Joseph Morano
*Attorney, Agent, or Firm*—Herbert Dubno

[57] ABSTRACT

A track support element for a maglev track has an upper member consisting of a steel fiber concrete plate provided with the mounting elements for attachment of the maglev rails, stator and the like. This plate is connected by steel struts to a lower member which can be a steel tube filled with steel fiber concrete.

10 Claims, 2 Drawing Sheets

TRACK CARRIER FOR A HIGH SPEED MAGNETIC LEVITATION TRANSPORT SYSTEM

FIELD OF THE INVENTION

Our present invention relates to a track carrier for a high speed magnetic levitation transport system and, more particularly, to a track carrier of the type which comprises a steel lower beam, an upper beam or flange (using truss terminology) and steel bars or webs inclined outwardly and upwardly and connecting the upper beam to the lower beam.

The upper beam is provided with laterally outwardly projecting portions beyond these webs upon which the magnetic levitation guide or support rails are provided and means is provided upon the upper beam or flange to carry the stators which generally cooperate with the magnetic levitation vehicle to provide the linear motor which propels the latter.

BACKGROUND OF THE INVENTION

The tracks of high speed magnetic transportation systems, especially magnetic levitation systems or maglevs, generally comprise on posts or the like a multiplicity of track carriers of reinforced concrete or steel and supporting the stator rail or rails and the guide rail or rails for the vehicle.

A typical track carrier of this type has a generally closed and substantially trapezoidal cross section formed by an upper plate which projects laterally beyond the longitudinal ribs on the underside of the cover plate which are connected, in turn, to the lower flange of the girder or truss formed by the carrier, by downwardly extending webs, braces or struts.

Lateral plate strips are provided on the projecting sides of the cover plate for use in the magnetic driver or guidance, e.g. mounting the guide rails, for example. Lateral guide rails, the longitudinal stator and other rails participate in the magnetic and mechanical support of the vehicle, its displacement and its guidance.

The mounting parts must be positioned with great precision in view of the high speeds of the maglev vehicles. Furthermore, the track carrier must have a minimum deformation under load and temperature variations and must have a minimum characteristic frequency to prevent the buildup of resonant states.

A prior art track carrier of the aforedescribed type is illustrated and described in *Bauingenieur* 60, 1988, pp. 463–469 and is fabricated completely from steel. While this system has the advantage of low intrinsic weight it does have stability problems.

It is also known to provide track carriers for high speed transport systems which are composed entirely of reinforced concrete, but these systems have the drawback of very high intrinsic weight.

OBJECTS OF THE INVENTION

It is, therefore, the principal object of the present invention to provide an improved track carrier which can provide accurate positioning of the various rail and stator attachment devices will have a minimum characteristic frequency of vibration, can withstand the load variations associated with high speeds of maglev vehicles and which will have especially high-shape stability under load and temperature differentials, without drawbacks of earlier systems.

Another object of the invention is to provide an improved track carrier which has the advantages of both the reinforced concrete and the all-steel carriers described above, but without their respective drawbacks.

Still another object is to provide a track support for a maglev vehicle which is particularly effective for use in high speed transport systems in which such vehicles are provided, at relatively low cost and without disadvantages of earlier maglev track supports.

SUMMARY OF THE INVENTION

These objects and others which will become apparent hereinafter are attained, in accordance with the present invention, in a track carrier for a high speed maglev system which comprises a steel lower flange or girder, an upper flange or girder provided with laterally projecting mounting strips, at least two struts welded to the steel lower flange and engaging the upper flange at a pair of longitudinal ribs formed on the underside of the upper flange and inclined upwardly away from one another at an acute angle. According to the invention, the upper flange is a steel fiber containing a concrete plate with longitudinal and/or transverse reinforcing members. The term "steel fiber concrete plate" is used herein to refer to a concrete plate which has incorporated therein, in addition to the longitudinal and transverse reinforcement bars or cables providing prestress and thereby making the plate a prestressed concrete plate, a quantity of steel fibers which are embedded in the concrete. The steel fibers can be embedded in the concrete in any desired quantity, but advantageously constitute five percent by weight or more of the hardened concrete. The steel fibers can be present in an amount which at a maximum is in a weight ratio of 1:3 with the total of gravel and sand contained in the concrete and the fibers can have diameters ranging from 0.05 mm to 2.5 mm and lengths ranging from 5 mm to 7 mm.

The track carrier of the invention thus represents a composite structure which, by comparison with all-steel, reinforced concrete or prestressed concrete constructions which do not use a steel fiber concrete, has the following advantages:

Reduced stability problems by comparison to all-steel truss-type structures.

With respect to the loading of the track by sudden loads or load peaks, a higher inertial resistance to displacement or distortion than all-steel constructions.

Reduced intrinsic weight of the track carrier than with reinforced concrete or prestressed concrete for a given load-carrying capacity.

Reduced mounting loads of the prefabricated track carrier by comparison with reinforced concrete or prestressed concrete for a given load-carrying capacity.

The possibility of including additional stressing members or tension elements without bonding to the plate to enable possible later correction of the configuration of the support structure by after-tensioning or the like.

Improved corrosion-resistance by contrast with all-steel structures.

We have found, moreover, that the use of steel fiber concrete for the upper flange of the support structure has the following specific advantages over other known constructions:

Reduced bending tendencies because of the utilization of the tensile strength of the steel fiber concrete so that there is less need for reinforcement or prestressing to counter such bending tendencies.

The ability to utilize most effectively the especially high compressive strength of the steel fiber concrete.

Simplified end anchoring of the prestressing members and improved anchoring of the mounting elements for the rails by utilization of the especially effective tensile and shear characteristics of the steel fiber concrete.

At the interface at which the steel fiber concrete meets the elements embedded therein or attached thereto, there is an improved force transmission between the concrete and the elements with steel fiber concrete which is especially advantageous for set-bolt attachments.

Effective utilization of not only the static properties of steel fiber concrete, but also its ability to withstand the high dynamic stresses arising in maglev tracks and resulting from the complex mechanism of the interaction between the fibers and the concrete structure whereby the steel fibers require any crack formation to be finely distributed and minimize the enlargement of microcracks.

A reduced corrosion of the reinforcing rods or bars within the concrete which also appears to be a characteristic of steel fiber concrete and reduces the deterioration of the concrete structure in the long run.

The presence of a viscoplastic characteristic of the steel fiber concrete which avoids embrittlment and cracking in the region in which the stressing elements are anchored and at the various joints which are formed in the concrete.

Advantageously, the density of the steel fibers in the steel fiber concrete plate can be varied so that at the various joint regions, for example, this density will be increased.

The steel fiber concrete plate preferably should have a Greek pi letter-shaped cross-section.

The downwardly extending ribs which run longitudinally along the plate can be provided with set-bolt pins or other connecting devices for attachment to the steel struts.

It has been found to be advantageous, moreover, to provide the plate with transverse ribs which can engage additional longitudinal tension or stressing elements without bonding thereto to enable, if necessary, a correction of the track gradient in an especially simple manner.

The steel lower flange of the support structure can be filled with concrete and especially steel fiber concrete, if desired.

The result is an increase in the stability in multi-field constructions as well as a reduction in the possibility of corrosion because internal corrosion is prevented. The filling of the tubular lower flange with steel fiber concrete, moreover, has been found to be advantageous for the dynamic responses of the support. Of course, additional longitudinal reinforcement or stressing elements can be provided in the tubular steel flanges as well.

BRIEF DESCRIPTION OF THE DRAWING

The above objects, features and advantages of our invention will become more readily apparent from the following description, reference being made to the accompanying drawing in which.

SPECIFIC DESCRIPTION

Figure 5:
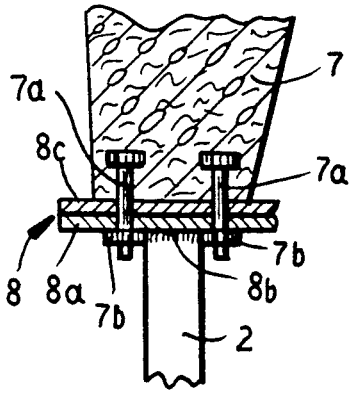
FIG. 5 is a detail view illustrating the attachment of the strut to the longitudinal rib of the structure of FIGS. 1—4.

The track carrier of the invention is intended to be utilized in the manner generally described and illustrated in connection with FIGS. 5–7 of the *Bauingenieur* publication cited above.

The track carrier is utilized for a high-speed maglev track and basically comprises a tubular steel lower flange 1, a plurality of steel struts 2 extending upwardly from the lower flange 1 and shown to consist of at least two such struts inclined at an acute angle to one another and welded to the steel tube 1 and an upper flange or platform 3 affixed to the free upper ends of the steel struts 2 and having laterally projecting mounting strips 4 which can carry the various mounting devices 4*a*, 4*b* for attachment of the magnetic guide rails, longitudinal stators, etc. with which the track may be equipped.

Figure 1:
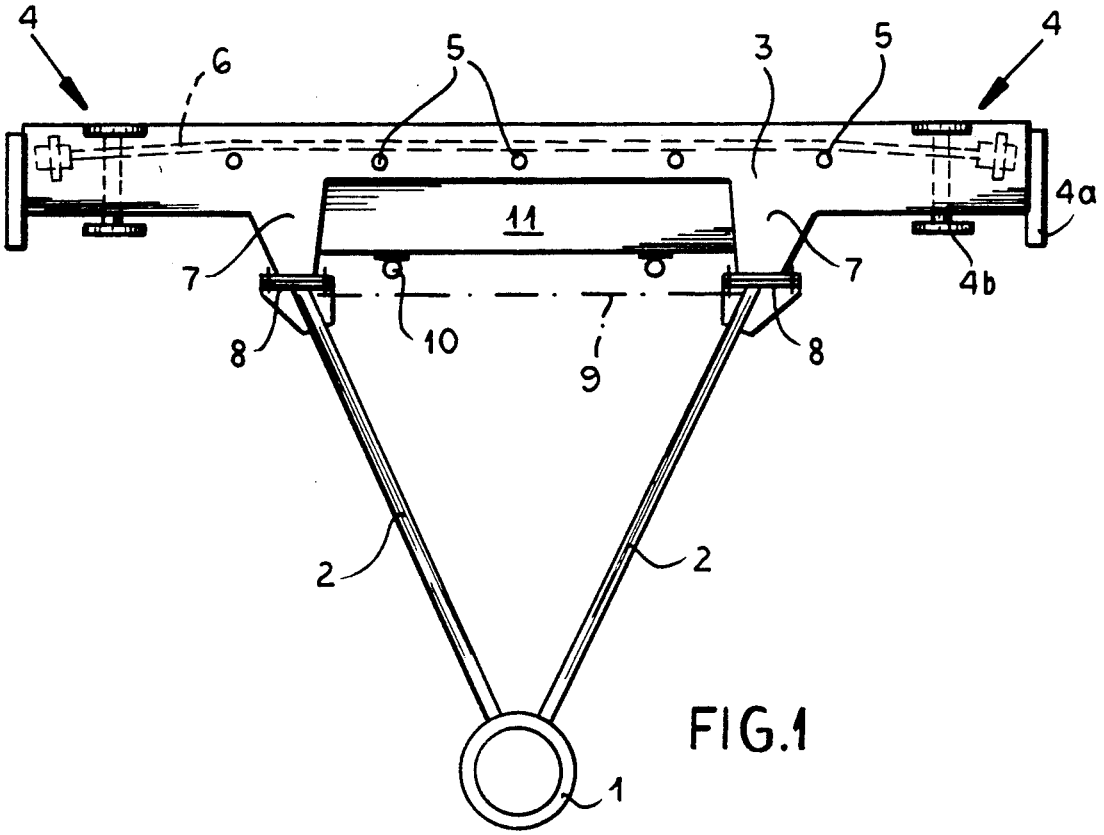
FIG. 1 is an end view, showing the longitudinal prestressing elements in cross-section, of a track carrier according to the invention.
Figure 3:
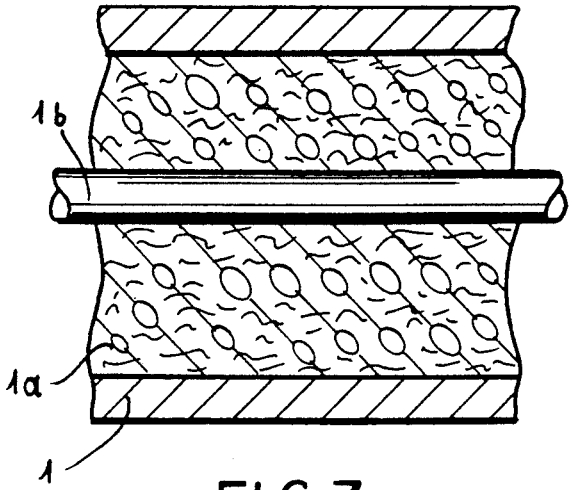
FIG. 3 is a section through the lower flange of the support structure.

The tubular steel flange 1 can have a circular cross section as is best seen in FIG. 1 and can be filled with a steel fiber concrete 1*a* and can be traversed by a longitudinal prestressing cable or rod 1*b* anchored in the concrete 1*a*, if desired (see FIG. 3).

Figure 2:
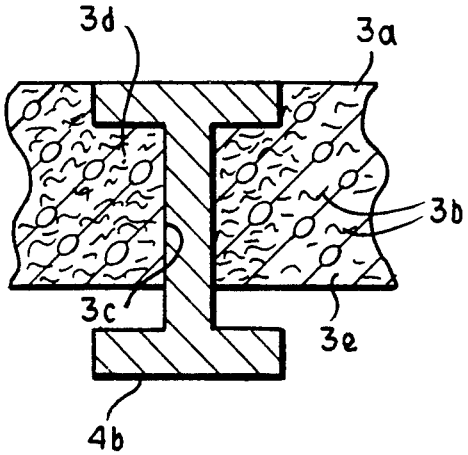
FIG. 2 is a detail view of a section of the carrier at its region with a junction with a mounting element for a track, rail or stator of the maglev track.

The upper member 3 has a Greek pi letter-shaped cross-section and consists of a steel fiber concrete plate. For example, the concrete 3*a* (FIG. 2) is shown to be provided with steel fibers 3*b* as has previously been described. In the region of the mounting element 4*b*, i.e. at the junctions 3*c*, between the concrete and the mounting element 4*b*, the steel fiber density at 3*d* may be greater than at the regions 3*e*, for example more remote from these junctions (FIG. 2).

The steel fiber concrete plate is prestressed and reinforced in the longitudinal and transverse directions with longitudinal and transverse prestressing elements 5 and 6, respectively.

The girderlike connection between the longitudinal ribs 7 of the steel fiber concrete plate elements is represented at 8. For example, from FIG. 5, it can be seen that the flange 8*a* is welded at 8*b* to the strut 2 and abuts a load-transmitting flange 8*c* applied to the underside of the rib 7 which has set-bolts 7*a* embedded therein. The plates 8*a* and 8*c* are held together and to the underside of the rib 7 by the bolts 7*a* and the nuts 7*b* threaded onto these bolts.

As is shown by dot-dash line in FIG. 1, transverse struts, strips or bands 9 can be provided between the steel struts 2 during fabrication and assembly and can be removed when the construction is complete. Of course, such additional struts or bands can be left in place.

Figure 4:
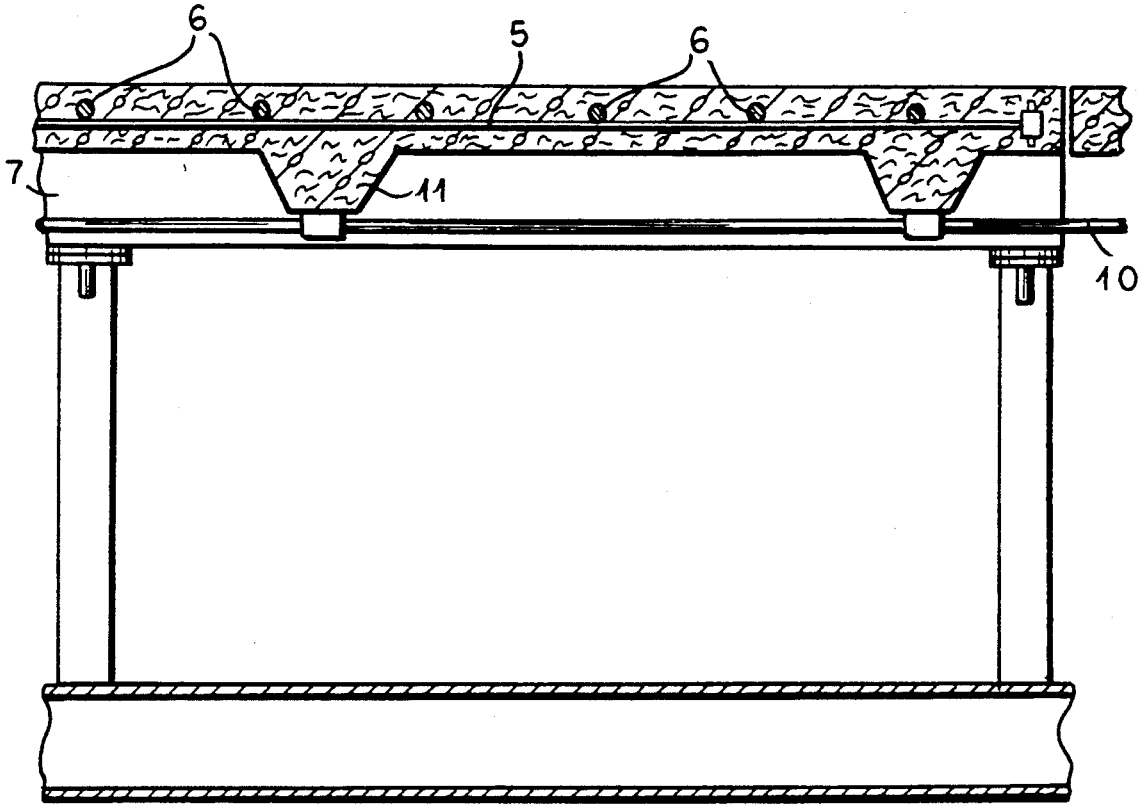
FIG. 4 is a cross-sectional view through the structure of FIG. V.

It will also be apparent, especially from FIGS. 1 and 4 that additional longitudinal stressing elements 10 without bonding to the concrete can bear against the transverse ribs 11 of the steel fiber reinforced concrete for correction of the track gradient and to the extent that such correction may be required. The height of the transverse rib can be varied along the track as may be required.

We claim:

1. A track carrier for a high speed maglev track, comprising a steel lower member, a pair of upwardly and outwardly extending struts including an acute angle between them and welded to said lower member, and an upper member connected to upper ends of said struts and having mounting strips projecting laterally beyond said struts for the connection of rails for said track, said upper member being constituted as a steel fiber concrete plate with stressing elements extending therethrough and embedded therein, said stressing elements selected from the group consisting of longitudinal and transverse elements extending respectively in a longitudinal and transverse direction of said plate, said plate having substantially a Greek pi letter-shaped cross-section with first ribs extending, said steel fiber concrete plate being provided with second ribs transversely oriented with respect to said first ribs along said underside of said plate, and wherein additional longitudinal stressing elements capable of adjusting a track gradient are held without bonding adjacent to an undersurface of said second ribs.

2. The track carrier defined in claim 1, wherein said stressing elements include longitudinal stressing elements extending in a longitudinal direction of said plate.

3. The track carrier defined in claim 2 wherein said stressing elements include transverse stressing elements extending transversely to said longitudinal stressing elements in said plate.

4. The track carrier defined in claim 1 wherein said first ribs along an underside of said plate are connected by bolts with said struts.

5. The track carrier defined in claim 1 wherein said lower member is a tubular member.

6. The track carrier defined in claim 5 wherein said tubular member is filled with steel fiber concrete.

7. The track carrier defined in claim 6, further comprising longitudinal stressing elements embedded in the steel fiber concrete in said tube.

8. The track carrier defined in claim 1 wherein said steel fiber concrete plate comprises at least 5% by weight steel fibers.

9. The track carrier defined in claim 1 wherein said steel fiber concrete plate comprises at maximum a weight ratio of 1:3 of steel fibers and a mixture of gravel and sand.

10. The track carrier defined in claim 1 wherein said steel fiber concrete plate comprises steel fibers having diameters ranging from 0.05 mm to 2.5 mm and lengths ranging from 5 mm to 7 mm.

* * * * *